US011737493B2

(12) United States Patent
Liu

(10) Patent No.: US 11,737,493 B2
(45) Date of Patent: Aug. 29, 2023

(54) ATOMIZATION ASSEMBLY AND ELECTRONIC CIGARETTE COMPRISING THE SAME

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 351 days.

(21) Appl. No.: 17/019,394

(22) Filed: Sep. 14, 2020

(65) Prior Publication Data

US 2021/0289838 A1 Sep. 23, 2021

(30) Foreign Application Priority Data

Mar. 20, 2020 (CN) ..... 202010206838.1
Mar. 20, 2020 (CN) ..... 202020373230.3

(51) Int. Cl.

| | |
|---|---|
| ***A24F 40/10*** | (2020.01) |
| ***A24F 40/30*** | (2020.01) |
| ***A24F 40/42*** | (2020.01) |
| ***A24F 40/46*** | (2020.01) |
| ***A24F 40/50*** | (2020.01) |
| ***A24F 40/60*** | (2020.01) |

(52) U.S. Cl.

CPC ..... *A24F 40/30* (2020.01); *A24F 40/10* (2020.01); *A24F 40/42* (2020.01); *A24F 40/46* (2020.01); *A24F 40/50* (2020.01); *A24F 40/60* (2020.01)

(58) Field of Classification Search

CPC ..... A24F 40/10; A24F 40/30; A24F 40/42; A24F 40/46; A24F 40/50; A24F 40/60

See application file for complete search history.

(56) References Cited

U.S. PATENT DOCUMENTS

| | | | | |
|---|---|---|---|---|
| 9,271,528 | B2 * | 3/2016 | Liu | A61M 11/042 |
| 9,301,547 | B2 * | 4/2016 | Liu | A24F 40/485 |
| 9,497,994 | B2 * | 11/2016 | Liu | A61M 11/042 |
| 10,111,468 | B2 * | 10/2018 | Fornarelli | H05B 3/44 |
| 10,123,568 | B1 * | 11/2018 | Zhu | A24F 40/46 |
| 10,412,785 | B1 * | 9/2019 | Schwartz | H05B 3/06 |
| 10,653,180 | B2 * | 5/2020 | Monsees | A24F 40/30 |
| 11,439,183 | B2 * | 9/2022 | Woodcock | G08B 21/182 |
| 2014/0190503 | A1 * | 7/2014 | Li | A24F 40/60 131/329 |
| 2014/0261488 | A1 * | 9/2014 | Tucker | A24F 40/50 131/328 |
| 2014/0332019 | A1 * | 11/2014 | Liu | A24F 40/50 392/404 |
| 2017/0095004 | A1 * | 4/2017 | Liu | H05B 1/0244 |
| 2017/0367402 | A1 * | 12/2017 | Lau | A24F 40/485 |
| 2018/0289069 | A1 * | 10/2018 | Reevell | A24F 40/50 |
| 2020/0037667 | A1 * | 2/2020 | Woodcock | A24F 40/53 |

FOREIGN PATENT DOCUMENTS

| | | | | |
|---|---|---|---|---|
| WO | WO-2015135115 | A1 * | 9/2015 | A24F 47/008 |

* cited by examiner

*Primary Examiner* — Abdullah A Riyami
*Assistant Examiner* — Thang H Nguyen
(74) *Attorney, Agent, or Firm* — Matthias Scholl P.C.; Matthias Scholl

(57) ABSTRACT

An atomization assembly, including two or more heating elements and an e-liquid tank. The e-liquid tank includes two or more compartments, and the two or more heating elements are disposed in the two or more compartments of the e-liquid tank, respectively. Also provided is an electronic cigarette including the atomization assembly.

2 Claims, 5 Drawing Sheets

ATOMIZATION ASSEMBLY AND ELECTRONIC CIGARETTE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202010206838.1 filed Mar. 20, 2020, and to Chinese Patent Application No. 202020373230.3 filed Mar. 20, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an atomization assembly and an electronic cigarette comprising the same.

A conventional electronic cigarette includes an atomization assembly and a battery assembly. The conventional atomization assembly comprises a single heating element.

SUMMARY

The disclosure provides an atomization assembly, comprising two or more heating elements and an e-liquid tank; the e-liquid tank comprises two or more compartments, and the two or more heating elements are disposed in the two or more compartments of the e-liquid tank, respectively.

The atomization assembly further comprises a mouthpiece, a seal plug, a silicone seal, an isolation seat, an atomizer, a fixed seat, an insulation ring, a plurality of joints, a base, and a stainless iron; wherein the atomizer is disposed on the fixed seat; the insulation ring is disposed in a bottom end of the fixed seat to separate positive and negative leads of the atomizer.

The fixed seat is disposed in the isolation seat to separate the atomizer; the silicone seal is disposed on the isolation seat to seal the two or more compartments of the e-liquid tank.

The isolation seat is disposed in the e-liquid tank and is connected to the two or more compartments; the base is disposed on a bottom end of the e-liquid tank, and the positive and negative leads of the atomizer are fixed on the base via the plurality of joints.

The e-liquid tank comprises a top end and an e-liquid injection hole disposed on the top end, and the seal plug is disposed in the e-liquid injection hole of the e-liquid tank: the mouthpiece is disposed on the top end of the e-liquid tank; the stainless iron is disposed on a bottom end of the e-liquid tank, is connected to a battery assembly, and contacts the plurality of joints for electric conduction.

Also provided is an electronic cigarette comprising the aforesaid atomization assembly.

The electronic cigarette further comprises a battery assembly; wherein the battery assembly is disposed on a bottom end of the atomization assembly; the battery assembly comprises a top end, an electrode pair disposed on the top end, a button, and a control panel; the electrode pair of the battery assembly is electrically connected to the stainless iron of the atomization assembly; the control panel comprises two or more control circuits; when in use, a current output is switchable between the two or more control circuits by continuously pressing the button to power on or power off the electrode pair.

The battery assembly further comprises a silicone sleeve, a magnet, a housing, a first support, a second support, a gasket, a silicone cap, a battery, and a USB panel; the electrode pair is disposed on a top end of the first support to supply power to the atomization assembly; the magnet is disposed on the top end of the first support and is magnetically connected to the atomization assembly.

The silicone sleeve is disposed on the top end of the first support to insulate the electrode pair; an output end of the battery is soldered to the control panel to supply power to the control panel; and the USB panel is soldered to the control panel to charge the battery.

The control panel, the battery and the USB panel are disposed on the first support; an output end of the control panel is soldered on the electrode pair; the silicone cap is disposed on a power button of the control panel; the second support is disposed on the control panel and abuts against the power button of the control panel to fix the button; the button is supported by the gasket and disposed on the second support.

The atomization assembly comprises two or more compartments and two or more heating elements disposed in the two or more compartments, respectively. The working mode of the atomizer is switchable by continuously pressing the button. That is, the two or more heating elements can work alone or simultaneously, and different compartments can be filled with different e-liquid materials.

DETAILED DESCRIPTION

To further illustrate, embodiments detailing an electronic cigarette are described below. It should be noted that the following embodiments are intended to describe and not to limit the disclosure.

In the disclosure, the e-liquid materials refer to smoke juice, vaping fluid, vape oil or other materials can be atomized to produce vapor.

Figure 1:
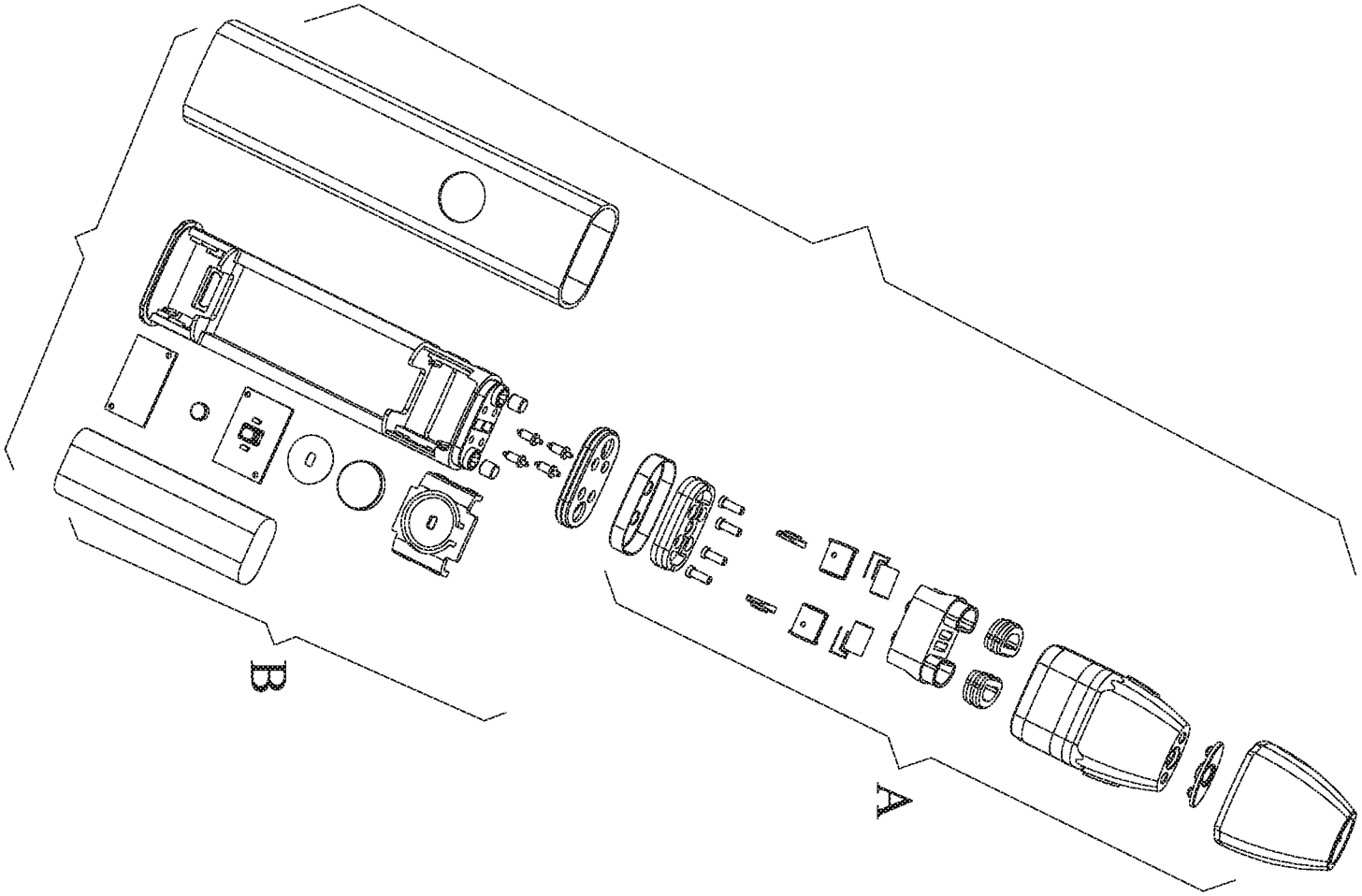
FIG. 1 is an exploded view of an electronic cigarette according to one embodiment of the disclosure.
Figure 2:
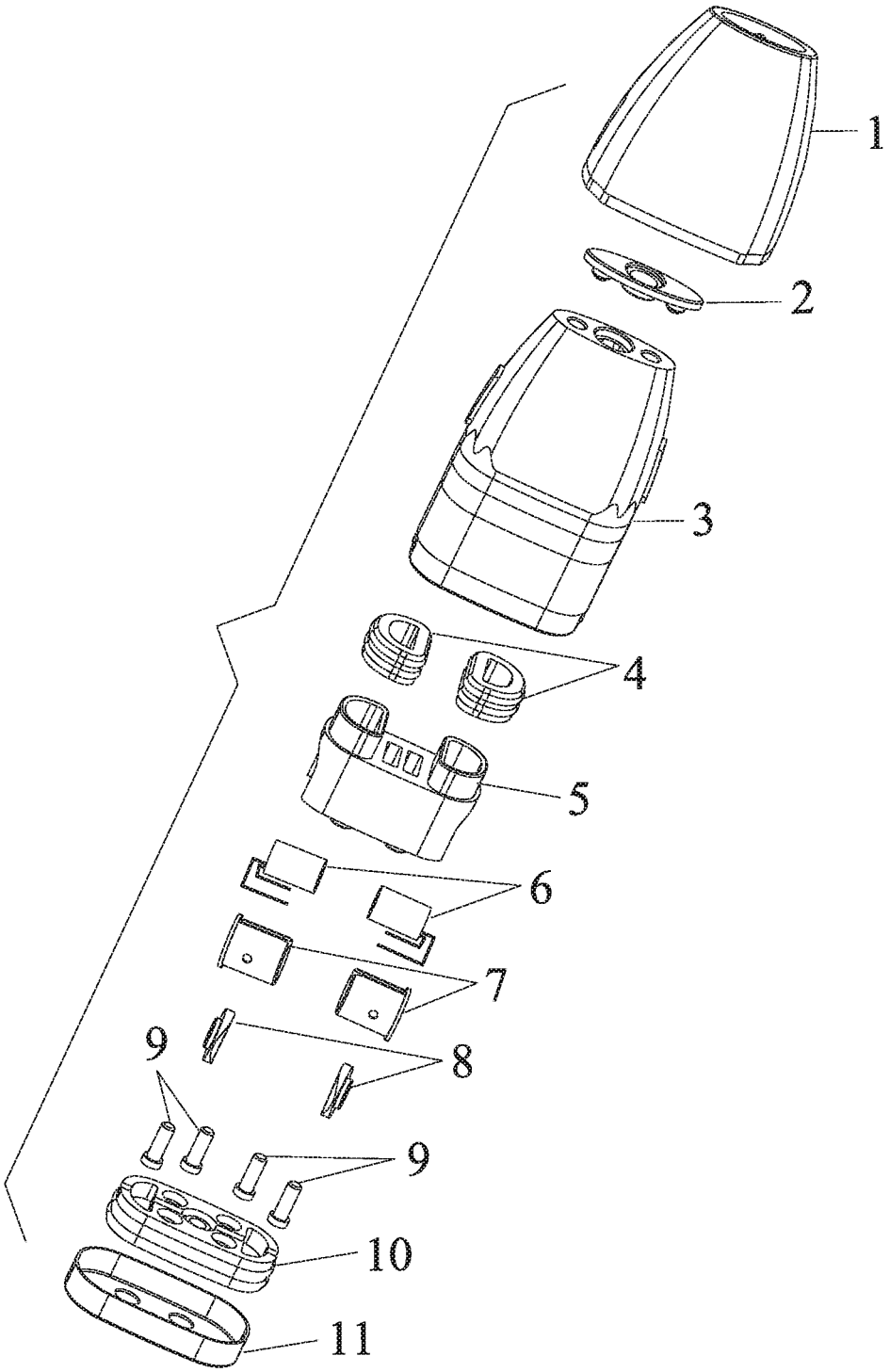
FIG. 2 is an exploded view of an atomization assembly of an electronic cigarette in FIG. 1.
Figure 3:
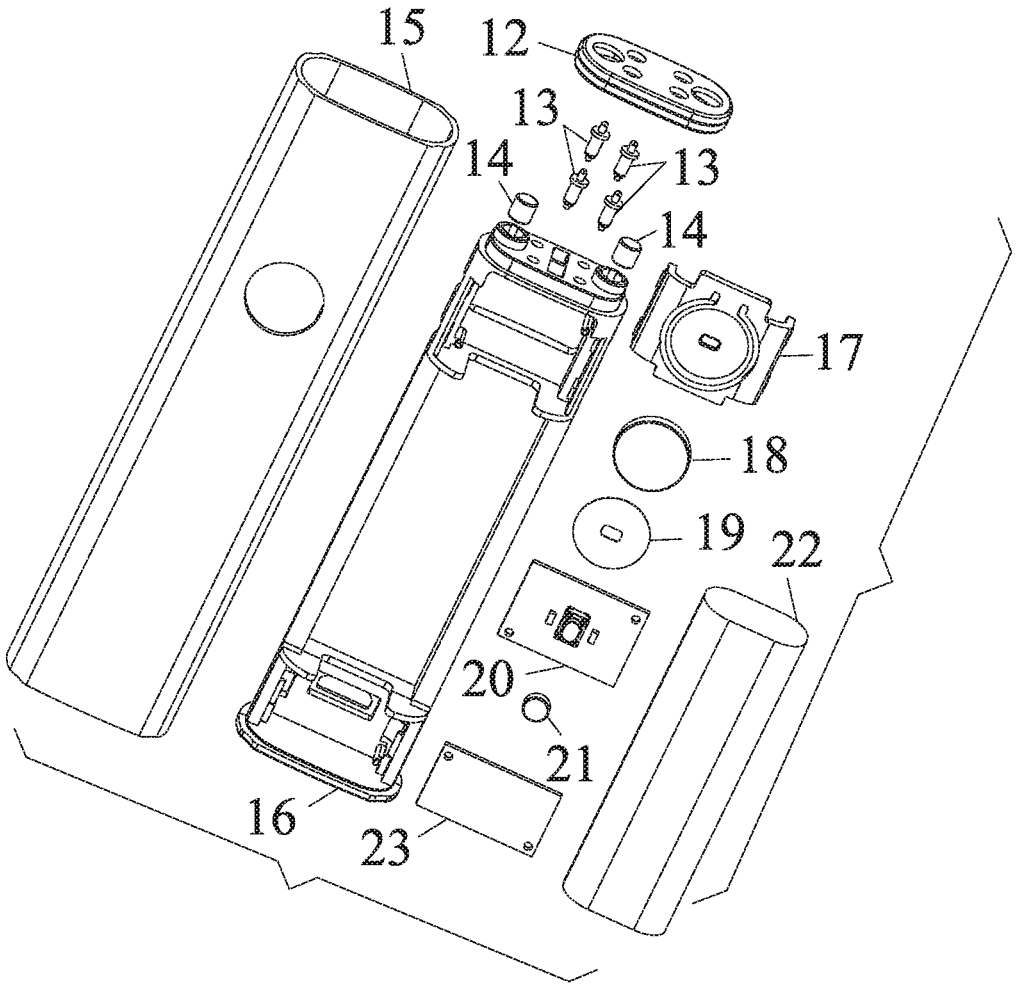
FIG. 3 is an exploded view of a battery assembly of an electronic cigarette in FIG. 1.
Figure 4:
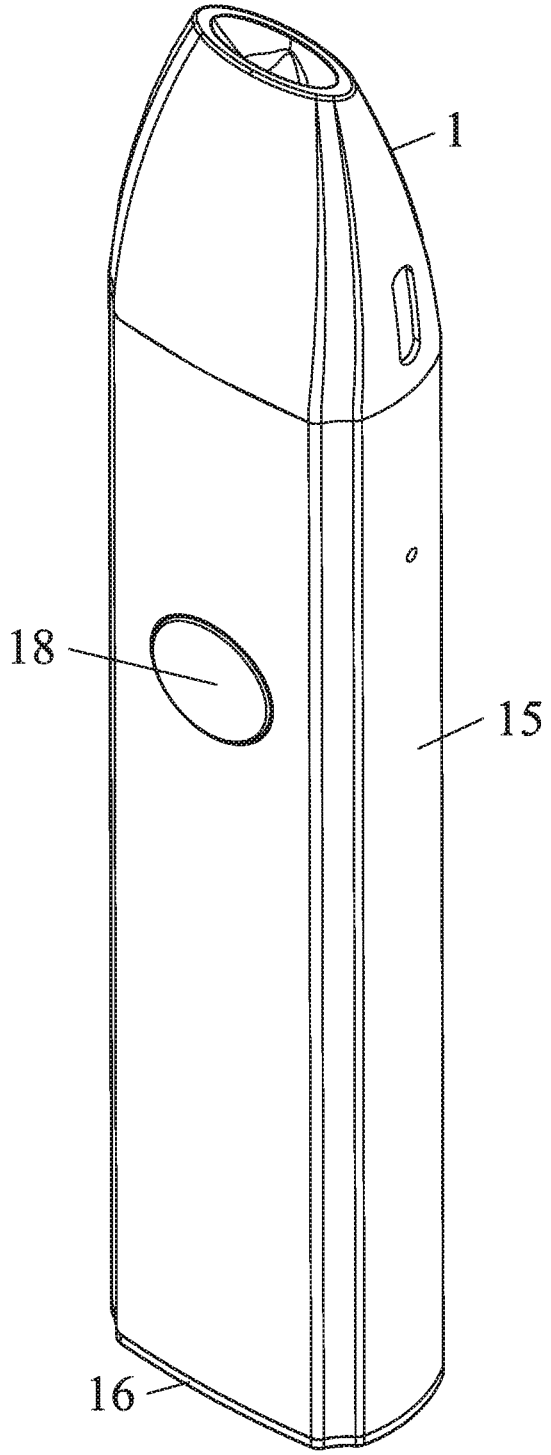
FIG. 4 is a schematic diagram of an electronic cigarette according to one embodiment of the disclosure.
Figure 5:
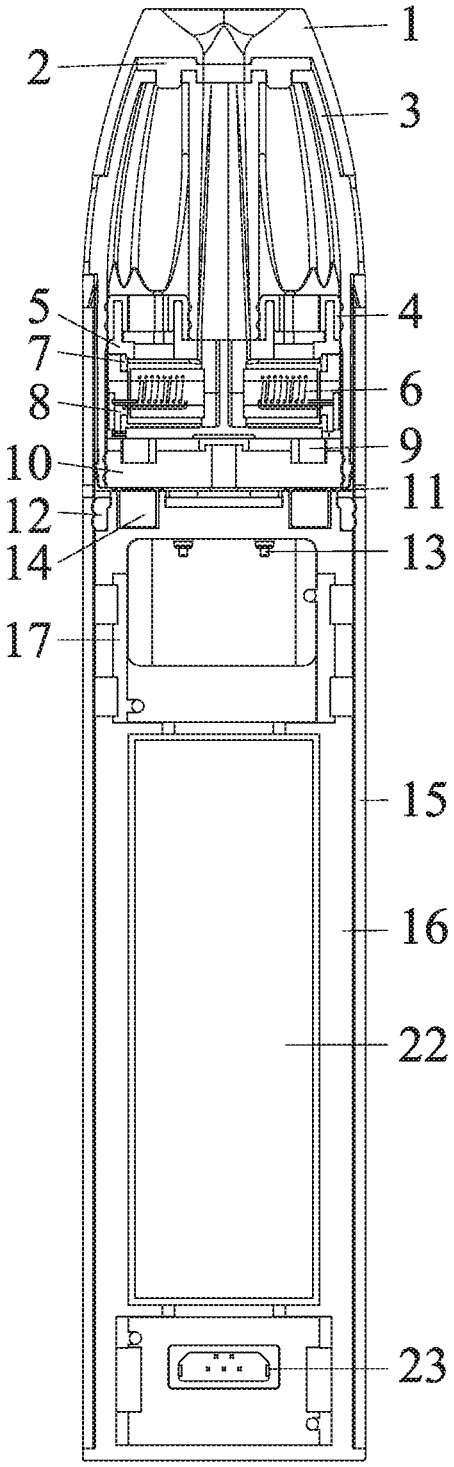
FIG. 5 is a sectional view of an electronic cigarette according to one embodiment of the disclosure.

As shown in FIGS. 1-5, provided is an atomization assembly comprising two or more heating elements and an e-liquid tank 3; the e-liquid tank 3 comprises two or more compartments, and the two or more heating elements are disposed in the two or more compartments of the e-liquid tank 3, respectively.

In this example, the atomization assembly comprises two heating elements.

The disclosure further provides an electronic cigarette, comprising an atomization assembly A and a battery assembly B. The atomizer 6 of the atomization assembly A comprises two heating elements. The e-liquid tank 3 comprises two compartments, and the two heating elements are disposed in the two compartments, respectively. Specifically, the atomization assembly comprises a mouthpiece 1, a seal plug 2, the e-liquid tank 3, a silicone seal 4, an isolation seat 5, an atomizer 6, a fixed seat 7, an insulation ring 8, a plurality of joints 9, a base 10, and a stainless iron 11; wherein the atomizer 6 is disposed on the fixed seat 7; the insulation ring 8 is disposed in a bottom end of the fixed seat 7 to separate positive and negative leads of the atomizer 6. The fixed seat 7 is disposed in the isolation seat 5 to separate the atomizer 6; the silicone seal 4 is disposed on the isolation seat 5 to seal the two or more compartments of the e-liquid tank 3. The isolation seat 5 is disposed in the e-liquid tank 3 and is connected to the two or more compartments; the base 10 is disposed on a bottom end of the e-liquid tank 3, and the positive and negative leads of the atomizer 6 are fixed on the base 10 via the plurality of joints 9. The e-liquid tank 3 comprises a top end and an e-liquid injection hole disposed on the top end, and the seal plug 2 is disposed in the e-liquid injection hole of the e-liquid tank 3; the mouthpiece 1 is disposed on the top end of the e-liquid tank 3; the stainless iron 11 is disposed on a bottom end of the e-liquid tank 3, is connected to a battery assembly, and contacts the plurality of joints 9 for electric conduction.

The battery assembly B comprises a silicone sleeve 12, an electrode pair 13, a magnet 14, a housing 15, a first support 16, a second support 17, a button 18, a gasket 19, a control panel 20, a silicone cap 21, a battery 22, and a USB panel 23. The electrode pair 13 is disposed on a top end of the first support 16 to supply power to the atomization assembly A; the magnet 14 is disposed on the top end of the first support 16 and is magnetically connected to the atomization assembly A. The silicone sleeve 12 is disposed on the top end of the first support 16 to insulate the electrode pair 13; an output end of the battery 22 is soldered to the control panel 20 to supply power to the control panel 20; and the USB panel 23 is soldered to the control panel 20 to charge the battery 22. The control panel 20, the battery 22 and the USB panel 23 are disposed on the first support 16; an output end of the control panel 20 is soldered on the electrode pair 13; the silicone cap 21 is disposed on a power button of the control panel 20; the second support 17 is disposed on the control panel 20 and abuts against the power button of the control panel 20 to fix the button 18; the button is supported by the gasket 19 and disposed on the second support 17.

In certain embodiments, the atomization assembly comprises two or more compartments and two or more heating elements disposed in the two or more compartments, respectively. The working mode of the atomizer is switchable by continuously pressing the button. That is, the two or more heating elements can work alone or simultaneously, and different compartments can be filled with different e-liquid materials.

The following advantages are associated with the electronic cigarette of the disclosure: the atomizer comprises two heating elements. The working mode of the atomizer is switchable by continuously pressing the button. That is, the two or more heating elements can work alone or simultaneously, and different compartments can be filled with different e-liquid materials.

It will be obvious to those skilled in the art that changes and modifications may be made, and therefore, the aim in the appended claims is to cover all such changes and modifications.

What is claimed is:

1. An atomization assembly, comprising two or more heating elements, an e-liquid tank, a mouthpiece, a seal plug, a silicone seal, an isolation seat, an atomizer, a fixed seat, an insulation ring, a plurality of joints, a base, and a stainless iron; wherein:

the e-liquid tank comprises two or more compartments;

the two or more heating elements are disposed in the two or more compartments of the e-liquid tank, respectively;

the atomizer is disposed on the fixed seat; the insulation ring is disposed in a bottom end of the fixed seat to separate positive and negative leads of the atomizer;

the fixed seat is disposed in the isolation seat to separate the atomizer; the silicone seal is disposed on the isolation seat to seal the two or more compartments of the e-liquid tank;

the isolation seat is disposed in the e-liquid tank and is connected to the two or more compartments; the base is disposed on a bottom end of the e-liquid tank, and the positive and negative leads of the atomizer are fixed on the base via the plurality of joints;

the e-liquid tank comprises a top end and an e-liquid injection hole disposed on the top end, and the seal plug is disposed in the e-liquid injection hole of the e-liquid tank; the mouthpiece is disposed on the top end of the e-liquid tank; the stainless iron is disposed on a bottom end of the e-liquid tank, is connected to a battery assembly, and contacts the plurality of joints for electric conduction.

2. An electronic cigarette, comprising an atomization assembly and a battery assembly; wherein:

the atomization assembly comprises two or more heating elements and an e-liquid tank;

the e-liquid tank comprises two or more compartments;

the two or more heating elements are disposed in the two or more compartments of the e-liquid tank, respectively;

the battery assembly is disposed on a bottom end of the atomization assembly; the battery assembly comprises a top end, an electrode pair disposed on the top end, a button, and a control panel; the electrode pair of the battery assembly is electrically connected to a stainless iron of the atomization assembly; the control panel comprises two or more control circuits; when in use, a current output is switchable between the two or more control circuits by continuously pressing the button to power on or power off the electrode pair;

the battery assembly further comprises a silicone sleeve, a magnet, a housing, a first support, a second support, a gasket, a silicone cap, a battery, and a USB panel; the electrode pair is disposed on a top end of the first support to supply power to the atomization assembly; the magnet is disposed on the top end of the first support and is magnetically connected to the atomization assembly;

the silicone sleeve is disposed on the top end of the first support to insulate the electrode pair; an output end of the battery is soldered to the control panel to supply power to the control panel; and the USB panel is soldered to the control panel to charge the battery; and the control panel, the battery and the USB panel are disposed on the first support; an output end of the control panel is soldered on the electrode pair; the silicone cap is disposed on a power button of the control panel; the second support is disposed on the control panel and abuts against the power button of the control panel to fix the button; the button is supported by the gasket and disposed on the second support.

* * * * *